United States Patent [19]

Hayashi

[11] Patent Number: 4,570,585

[45] Date of Patent: Feb. 18, 1986

[54] LIGHT METAL CYLINDER HEAD WITH VALVE SEAT INSERT

[75] Inventor: Yoshimasa Hayashi, Kamakura, Japan

[73] Assignee: Nissan Motor Co., Ltd., Yokohama, Japan

[21] Appl. No.: 482,306

[22] Filed: Apr. 5, 1983

[30] Foreign Application Priority Data

Apr. 21, 1982 [JP] Japan ..... 57-66514

[51] Int. Cl.[4] ..... F01L 3/02

[52] U.S. Cl. ..... 123/188 S; 29/156.7 A; 251/359; 251/368

[58] Field of Search ..... 123/188 AA, 188 S; 29/156.7 R, 156.7 A; 251/359, 368

[56] References Cited

U.S. PATENT DOCUMENTS

| | | | |
|---|---|---|---|
| 2,036,520 | 4/1936 | Fitzgerald | 123/188 S |
| 2,101,970 | 12/1937 | Wissler | 123/188 S |
| 2,178,895 | 11/1939 | Myers et al. | 123/188 |
| 2,600,529 | 6/1952 | Gregory | 123/188 S |
| 3,428,035 | 2/1969 | Stefan et al. | 123/188 |

FOREIGN PATENT DOCUMENTS

| | | | |
|---|---|---|---|
| 575295 | 4/1933 | Fed. Rep. of Germany | 123/188 S |
| 929157 | 5/1955 | Fed. Rep. of Germany . | |
| 729242 | 7/1932 | France . | |
| 807344 | 1/1937 | France | 123/188 S |
| 1238335 | 7/1960 | France . | |
| 625394 | 6/1949 | United Kingdom . | |

OTHER PUBLICATIONS

European Search Report–EP 83 10 3191.

*Primary Examiner*—Ira S. Lazarus

*Attorney, Agent, or Firm*—Schwartz, Jeffrey, Schwaab, Mack, Blumenthal & Evans

[57] ABSTRACT

A light metal cylinder head comprises a cast block and an annular valve seat insert formed from a heat-resisting sheet metal by pressing. The valve seat insert is embedded in the block by casting the block around the valve seat insert.

1 Claim, 8 Drawing Figures

LIGHT METAL CYLINDER HEAD WITH VALVE SEAT INSERT

BACKGROUND OF THE INVENTION

1. Field of the Invention

The present invention relates in general to light metal cylinder heads for internal combustion engines and more particularly to valve seat inserts thereof.

2. Description of the Prior Art

Valve seat inserts are widely used in current automobile engines having light metal or aluminum alloy cylinder heads.

FIG. 1 shows a prior art aluminum alloy cylinder head 10 having a cast, aluminum alloy block 12 with a water jacket 14. The block 12 has a hole 16 prepared by machining at an end of an intake or exhaust port 18. A valve seat insert 20 made of hard, heat-resisting metal is inserted into the hole 16 and held in place by interference fit. After insertion, the valve seating surface of the valve seat insert 20 is ground in a manner as to be aligned with a valve guide 22.

The prior art light metal cylinder head of the above described type encounters the following drawbacks. That is, it is of great importance for the valve seat insert 20 to fit tightly all around the hole 16 in order to provide efficient heat transfer from the valve seat insert 20 to the block 12. This, however, necessitates hightly accurate machining of the valve seat insert 20 and the hole 16 and therefore results in an expensive manufacturing cost. Further, the pressed-in insert 20 requires a wall portion 24 of the block 12 surrounding the hole 16 to be thick enough to have sufficient strength. This results in poor heat transfer from the valve seat insert 20 to the water jacket 14.

SUMMARY OF THE INVENTION

In accordance with the present invention, there is provided an improved light metal cylinder head which comprises a block that is cast in light metal and a valve seat insert that is embedded in the block by casting the block around the valve seat insert. The valve seat insert is formed from a heat-resisting sheet metal by pressing.

In accordance with the present invention, there is also provided a method of producing a light metal cylinder head equipped with a valve seat insert. The method comprises the steps of preparing the valve seat insert, preparing a mould for casing a cylinder head block in which the valve seat insert is to be installed, and pouring a mass of light metal into the mould to cast the block in the mould while allowing the valve seat insert to be embedded in the block when the mass of light metal becomes solid.

These structure and method are quite effective in solving the problems noted above.

It is accordingly an object of the present invention to provide an improved light metal cylinder head which can provide excellent heat transfer between a valve seat insert and an associated cylinder head block, without requiring any highly accurate, therefore expensive machining.

It is another object of the present invention to provide an improved light metal cylinder head of the above described character which can also provide excellent heat transfer between a valve seat insert and an associated water jacket.

It is a further object of the present invention to provide an improved light metal cylinder head of the above described character which can reduce the manufacturing cost.

BRIEF DESCRIPTION OF THE DRAWINGS

The features and advantages of the light metal cylinder head according to the present invention will become more clearly appreciated from the following description taken in conjunction with the accompanying drawings, in which.

DESCRIPTION OF THE PREFERRED EMBODIMENTS

Figure 1:
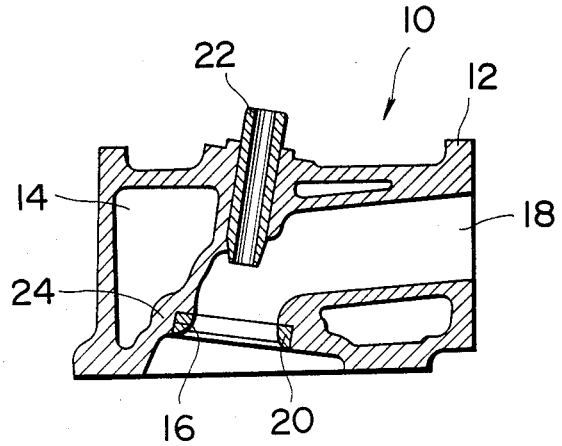
FIG.1 PRIOR ART
FIG. 1 is a sectional view of a prior art light metal cylinder head.
Figure 2:
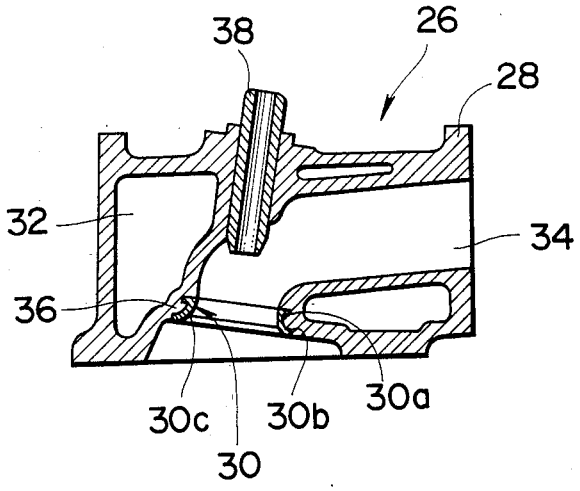
FIG. 2 is a view similar to FIG. 1 but shows a light metal cylinder head according to an embodiment of the present invention.

Referring to FIG. 2, a light metal cylinder head according to an embodiment of the present invention is generally indicated at 26 and comprises a cast block 28 and a valve seat insert 30 embedded in the block 28 at a predetermined position thereon by casting the block 28 around the valve seat insert 30.

More specifically, the block 28 is cast in light metal such as aluminum alloy and is formed with a water jacket 32 and also formed with intake and exhaust ports though only one port that may be either an intake port or an exhaust port is shown and designated by 34. The valve seat insert 30 is made of hard, heat-resisting metal such as SUH 33 (a heat-resisting steel according to Japanese Industrial Standards) and embedded in a wall portion 36 of the block 28 at an end of the intake or exhaust port 34. The valve seat insert 30 is in the form of a tapered ring or tube having a tapered inner surface smoothly and consecutively joined to the inner wall of the intake or exhaust port 34. The valve seat insert 30 has at the axially opposed ends thereof a pair of outward flanges **30*a* and 30*b* that are embedded in the block 28 to provide a firm joint between the valve seat insert 30 and the block 28**.

Figure 3A:
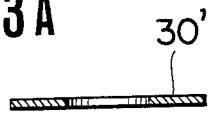
FIGS. 3A–3C are views of the pressing processes for preparing a valve seat insert incorporated in the cylinder head of FIG. 2.
Figure 3B:
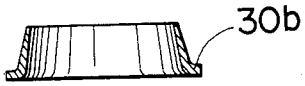
Figure 3C:
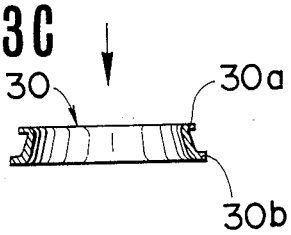

Preferably, the valve seat insert 30 is formed from a sheet metal by pressing or metal stamping as shown in FIGS. 3A–3C. That is, in producing the valve seat insert 30, an annular sheet metal blank 30' is first prepared. The blank 30' is formed into a tapered tube having the flange **30*b* at the larger diameter end thereof as shown in FIG. 3B and then formed with the flange 30*a* at the smaller diameter end as shown in FIG. 3C**.

In producing the light metal cylinder head 26, the valve seat insert 30 is first prepared preferably by pressing as mentioned above and hardened to have a good resistance to wear. The valve seat insert 30 is then set in a mould and afterwards a mass of molten aluminum alloy is poured into the mould and allowed to be cooled. In this connection, the pouring temperature should be lower than the transformation temperature of the heat resisting metal from which the valve seat insert 30 is formed. Selection of the materials for the block 28 and the valve seat insert 30 is made to meet this requirement. When the mass of aluminum alloy becomes solid, the valve seat insert 30 is firmly and integrally secured to the block 28. After being embedded in the block 28, the inner circumferential surface of the valve seat insert 30 is finish ground to form at the larger diameter end thereof a valve seating surface 30*c* that is aligned with a valve guide 38.

From the foregoing, it is to be understood that the valve seat insert 30 is united to the block 28 by a thermal and mechanical joint, that is, integrally joined with the block 28, thus providing excellent heat transfer from the valve seat insert 30 to the block 28.

It is further to be understood that the installation of the valve seat insert 30 does not require the highly accurate machining as in the case of the prior art insert, thus making it possible to reduce the manufacturing cost of the cylinder head 26.

It is still further to be understood that the valve seat insert 30 per se can be produced economically by pressing, making it possible to further reduce the manufacturing cost. In this connection, it is to be noted that the valve seat insert 30 can be a sheet metal pressing since it does not subjected to any large stress in installation, whereas the pressed-in valve seat insert in the prior art cylinder head is subjected to considerable stresses in installation and therefore cannot be so thin.

It is yet further to be understood that the cylinder head block wall portion 36 to which the valve seat insert 30 is embedded can be thinner as compared with the corresponding wall portion of the comparable prior art cylinder head block since it is unnecessary for the wall portion 36 to have sufficient strength for withstanding the stresses incurred in the insertion of the pressed-in valve seat insert, thus providing excellent heat transfer from the valve seat insert 30 to the water jacket 32.

Figure 4:
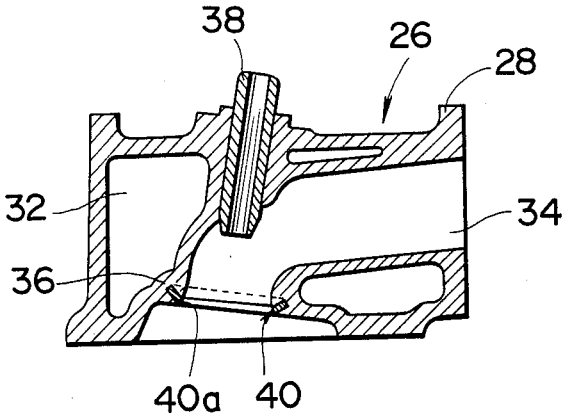
FIG. 4 is a view similar to FIG. 1 but shows a light metal cylinder head according to another embodiment of the present invention.

FIG. 4 shows another embodiment of this invention in which like or corresponding parts and portions to the previous embodiment are designated by like reference numerals.

This embodiment differs in the previous embodiment in that it comprises a valve seat insert 40 formed into a simpler, tapered ring without any flange. The valve seat insert 40 has a smaller diameter end peripheral surface that is exposed to form a valve seating surface 40*a* and embedded deeper into the block 28 as it extends toward the larger diameter end thereof. The valve seat insert 40 is embedded in the block 28 in a manner similar to the previous embodiment and thereafter the smaller diameter end peripheral surface is finish ground to form a valve seating surface 40*a* that is aligned with the valve guide 38.

Figure 5A:
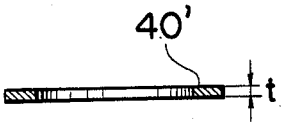
FIGS. 5A and 5B are views of the pressing processes for preparing a valve seat insert incorporated in the cylinder head of FIG. 4
Figure 5B:
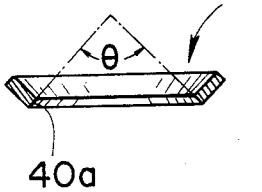

The valve seat insert 40 is preferably formed from a heat-resisting sheet metal by pressing as shown in FIGS. 5A and 5B. That is, in producing the valve seat insert 40, an annular sheet metal blank 40′ is first prepared. The sheet metal blank 40′ is of the thickness t equal to or a little bit larger than the desired width of the valve seating surface 40*a*, for example, 1.2–1.4 mm for intake port and 1.2–1.6 mm for exhaust port. The blank 40′ is then formed into a tapered ring having a smaller diameter end peripheral surface that is tapered to substantially coincide with the taper of the valve seating surface 40*a* (for example, 90° or 120° when measured by the angle $\theta$ indicated in FIG. 5B).

This embodiment is substantially similar to the previous embodiment except for the above and can produce substantially the same effect as the previous embodiment.

Obviously, numerous variations and modifications of the present invention are possible in light of the above teachings. It is therefore to be understood that within the scope of the appended claims, the invention may be practiced otherwise than as specifically described.

What is claimed is:

1. A light metal cylinder head comprising:

a block cast in light metal and having intake and exhaust ports; and an annular valve seat insert embedded in said block by casting said block around said valve seat insert;

wherein said valve seat insert is formed from heat-resisting sheet metal into a tapered ring by pressing and has at the axially opposed ends thereof a pair of outward flanges extending radially from said tapered ring and embedded in said block to provide a firm joint between said valve seat insert and said block and also has a tapered inner circumferential surface smoothly and consecutively joined to one of said ports and containing at the larger diameter end thereof a valve seating surface, said valve seat insert being in contact at all of the exterior surface thereof except for said inner circumferential surface with said block.

* * * * *